US006814020B2

(12) United States Patent
Maurel

(10) Patent No.: US 6,814,020 B2
(45) Date of Patent: Nov. 9, 2004

(54) COMPOSITE-SHELL PNEUMATIC CRAFT CONVERTIBLE INTO A CLOSED BOX

(75) Inventor: Didier Maurel, Fonsegrives (FR)

(73) Assignee: Zodiac International, Issy-Les Moulineaux (FR)

( * ) Notice: Subject to any disclaimer, the term of this patent is extended or adjusted under 35 U.S.C. 154(b) by 0 days.

(21) Appl. No.: 10/387,931

(22) Filed: Mar. 13, 2003

(65) Prior Publication Data

US 2003/0213422 A1 Nov. 20, 2003

(30) Foreign Application Priority Data

Mar. 13, 2002 (FR) ..... 02 03107

(51) Int. Cl.[7] ..... B63B 7/06
(52) U.S. Cl. ..... 114/345; 114/361
(58) Field of Search ..... 114/344, 345, 114/352, 353, 361

(56) References Cited

FOREIGN PATENT DOCUMENTS

| | | |
|---|---|---|
| FR | 2761042 | 10/1998 |
| FR | 2777531 | 7/2000 |

*Primary Examiner*—S. Joseph Morano
*Assistant Examiner*—Lars A. Olson
(74) *Attorney, Agent, or Firm*—Dean W. Russell; Kilpatrick Stockton LLP

(57) ABSTRACT

Composite-shell pneumatic craft convertible into a closed box, having a rigid hull and an inflatable float fixed to the edge thereof, a removable rigid panel constituting a lid for the hull containing the deflated float; a profile fixed along the outer edge of the hull comprises a supporting flank and a groove with narrow opening which opens into an upper wall close to the flank; the groove holds a bead joined to flexible skirt of the float; the upper wall, in its part adjacent to the groove opposite to the flank, can support a lip of the removable panel; a portion of the flank cooperates with members for fixing the profile to the hull.

7 Claims, 4 Drawing Sheets

FIG.5.
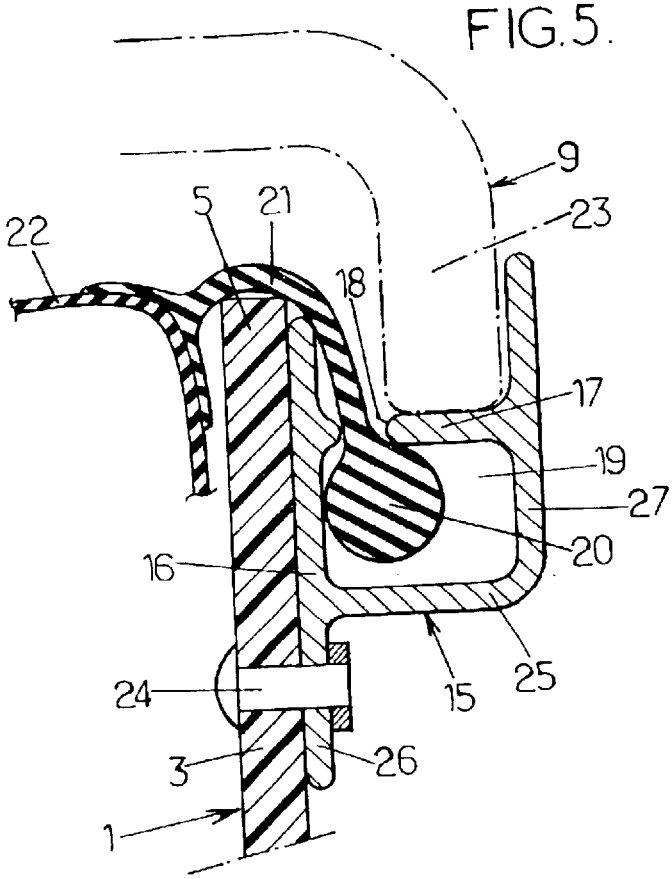
FIG.6.
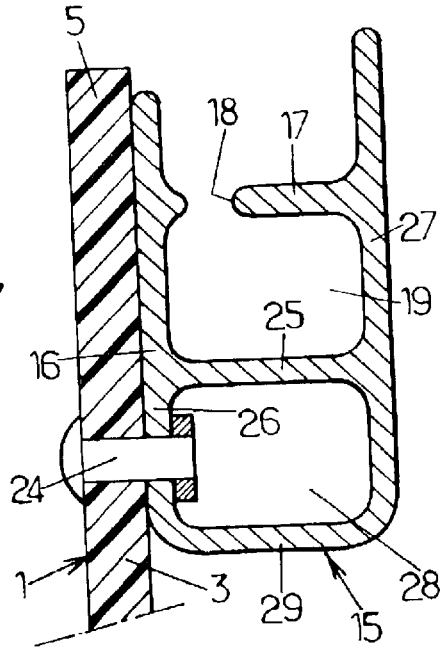
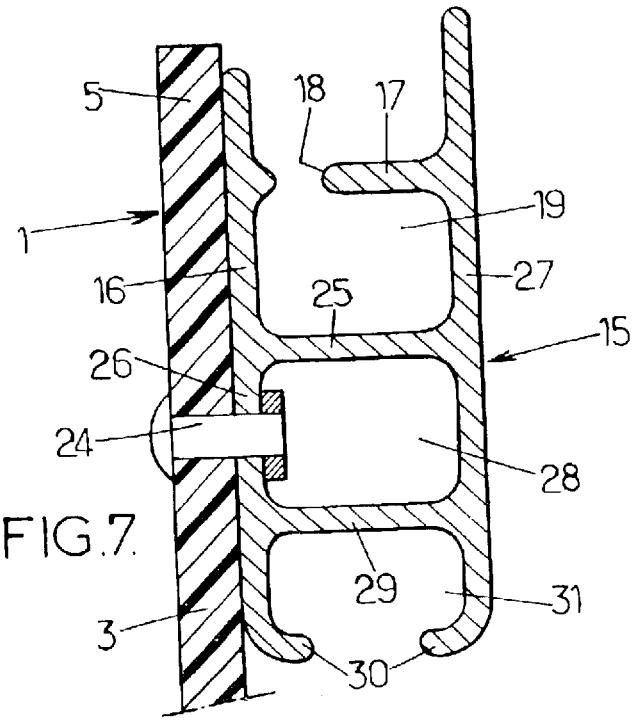
FIG.7.

COMPOSITE-SHELL PNEUMATIC CRAFT CONVERTIBLE INTO A CLOSED BOX

CROSS-REFERENCE TO RELATED APPLICATION

This application claims priority to French Patent Application No. 02 03107 filed on Mar. 13, 2002, the entire contents of which are hereby incorporated by reference.

FIELD OF THE INVENTION

The present invention relates to improvements made to composite-shell pneumatic craft convertible into a closed box for their storage and/or their transportation, comprising a rigid hull, the upper edge of which extends approximately in one plane, and an inflatable buoyancy tube fixed to said edge of the rigid hull—excluding the rear thereof—by joining means, a removable rigid panel being additionally provided and configured to match the contour of said upper edge of the hull in order to form a closing element for the hull, inside which the deflated tube has been folded flat.

DESCRIPTION OF THE PRIOR ART

According to document FR-A-2 761 042, a craft of the aforementioned type which, by virtue of its general arrangement, satisfies the sought-after object of ease of storage and transportation by automobile and also of a rapid and uncomplicated passage from the storage and transportation configuration to the navigation and inversion configuration, is known.

A crucial problem in this type of craft is to ensure, in navigation configuration, a reliable sealing tightness between the rigid hull and the inflated tube in order to prevent water from penetrating into the rigid hull by passing between this and the tube.

Another problem lies in the method of connecting the inflatable tube to the rigid hull to enable the passage from one configuration to the other to be made without removing/refitting the tube on the hull, in other words by allowing the tube to be permanently joined to the hull (the removal capability being reserved, for example, for workshop maintenance) and by swinging it on one side or other of the hull as required (inner side for storage/transportation, outer side for inflating and navigation).

A solution to these problems had appeared to be attainable by constituting the aforementioned joining means, as proposed in document FR-A-2 777 531, in the form of a profile having a section in the general shape of an inverted U, overlapping the upper edge of the hull and comprising:

- a first upwardly open groove, situated on the inside of the hull, configured with a narrow opening for holding a bead joined to the said tube, the bead being borne by a flexible skirt attached to the tube,
- a second upwardly open groove, situated on the outside of the hull, suitable for receiving the lip of the aforesaid rigid panel affixed to the hull in the closed box configuration and suitable for maintaining the flexible skirt of the inflated tube situated outside the hull in the craft configuration,
- and an elastomer strip situated externally beneath the second channel in order to form a seal-tight support for the inflated tube in the craft configuration.

In practice, however, the abovementioned profile did not adequately meet requirements. On the one hand, this profile is complex in shape and hence costly to produce. In addition, it requires the installation of a convex sealing strip designed to cooperate in a seal-tight manner with the buoyancy tube: not only does this strip add to the production cost, but the acquired sealing tightness, furthermore, is unsatisfactory and the water is able to penetrate, through there, into the craft. Finally, it has a part (holding groove for the bead) which is situated inside the craft and can hamper the occupants, or even be dangerous.

It has therefore proved necessary to modify the profile in question, whilst still preserving the principle of using a multifunction profile suitable for the hook-fastening of the buoyancy tube and for the cooperation with the edge of the lid in storage/transportation position, this multifunctionality having proved in practice to be effective and practical.

SUMMARY OF THE INVENTION

In this context, the object of the invention is therefore to propose an improved arrangement having a simply shaped and hence less costly profile, suitable for obtaining a seal-tight connection between the buoyancy tube and the rigid hull and preserving at least the aforementioned twin function.

To these ends, the invention proposes a pneumatic craft such as referred to above, which, being arranged according to the invention, is characterised in that the said joining means comprise a profile fixed to the outside of the hull, along the edge or close to the edge thereof, said profile comprising:

- a supporting flank against the hull, and
- a groove configured with a narrow opening which opens into an upper wall of the profile close to said supporting flank, said groove being suitable for holding a bead joined to a flexible skirt attached to the inflatable body,
- said upper wall of the profile being suitable, in its part adjacent to said groove opposite to said supporting flank of the profile, for supporting a lip of said removable panel,
- a portion of the supporting flank of the profile being configured to cooperate with members for fixing said profile to the hull.

Thus, owing to the fact that the profile no longer overlaps the upper edge of the wall of the hull but is fixed to the outer wall of the hull, the profile can be formed in a simple and relatively compact shape. Such a profile is easier to produce and is therefore cheaper and, furthermore, it has no part projecting inside the hull, likely to prove a nuisance, or even dangerous.

In navigation position, moreover, the whole of the flotation means (inflatable body, profile and connection between the two) are situated outside the rigid hull and there is no risk of water penetrating into the latter.

Advantageously, the profile can possess a second flank, opposite to said first supporting flank, and the two flanks can project above said upper wall, defining an upwardly open channel suitable for holding said removable panel transversely, such that, on the one hand, the supporting surface of the profile on the hull has grown and, on the other hand, the edge of the lid, in storage/transportation position, is enclosed in this channel and is held more effectively on the hull.

Also advantageously, the first supporting flank of the profile can comprise a wing projecting beneath the aforesaid groove and it is therefore this wing projecting at the bottom which is suitable for cooperating with members for fixing the profile to the hull. The inflatable buoyancy tube, whether in the inflated or deflated state, is therefore guaranteed not to come into contact with the fixing members, which can be protruding and aggressive (screws, rivets), and not to be torn to pieces.

It is therefore very interesting, moreover, to arrange for the profile to comprise a tubular part situated under said groove and for one wall of this tubular part to be formed by said wing. In effect, the connecting members which cooperate functionally with this wing are then protected in relation to the environment, and especially in relation to the inflatable tube. In addition, it becomes possible, once the profile is fixed on the hull, to seal off the ends of the said tubular part of the profile such that the water can no longer penetrate therein. The sealing tightness of the mechanical connections of the profile to the hull is thereby assured.

Finally, it is possible to provide for said two opposite flanks of the profile to extend at the bottom in the form of two lower wings situated opposite each other and defining a rail, and, by giving an appropriate configuration to these wings, it is possible to use them as hook-fastening elements for accessories.

BRIEF DESCRIPTION OF THE DRAWINGS

The invention will be more easily understood by reading the following detailed description of certain preferred embodiments, given solely by way of non-limiting examples. In this description, reference is made to the appended drawings, in which:

FIGS. 5 and 6 illustrate respectively two constructional variants of the profile of FIG. 4; and FIG. 7 illustrates yet another constructional variant, which is preferred, of the profile of FIG. 4.

DETAILED DESCRIPTION OF THE INVENTION

Figure 2:
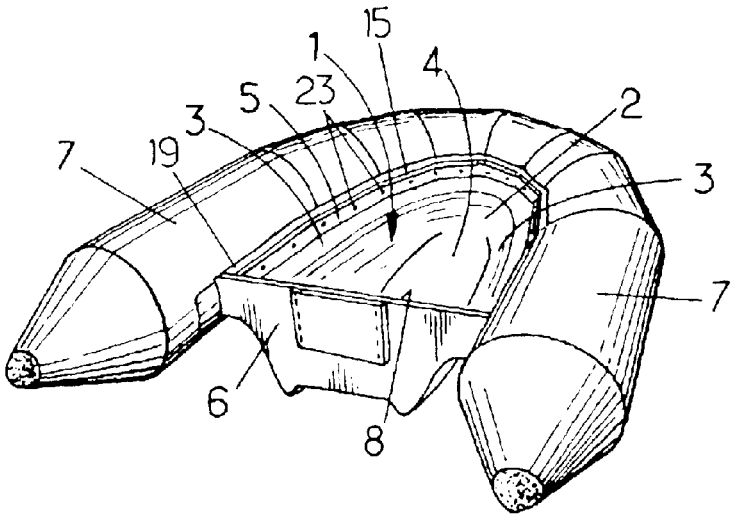
FIG. 2 is a perspective view of the same craft in its configuration as a composite-shell pneumatic craft ready for navigation.

Referring first of all to FIG. 2, the aggregate of elements allowing the composition of a craft forming the subject of the invention comprises a rigid tub 1, of elongated general shape, made of any appropriate material, especially of synthetic material used for the construction of rigid hulls of composite-shell craft.

Figure 1:
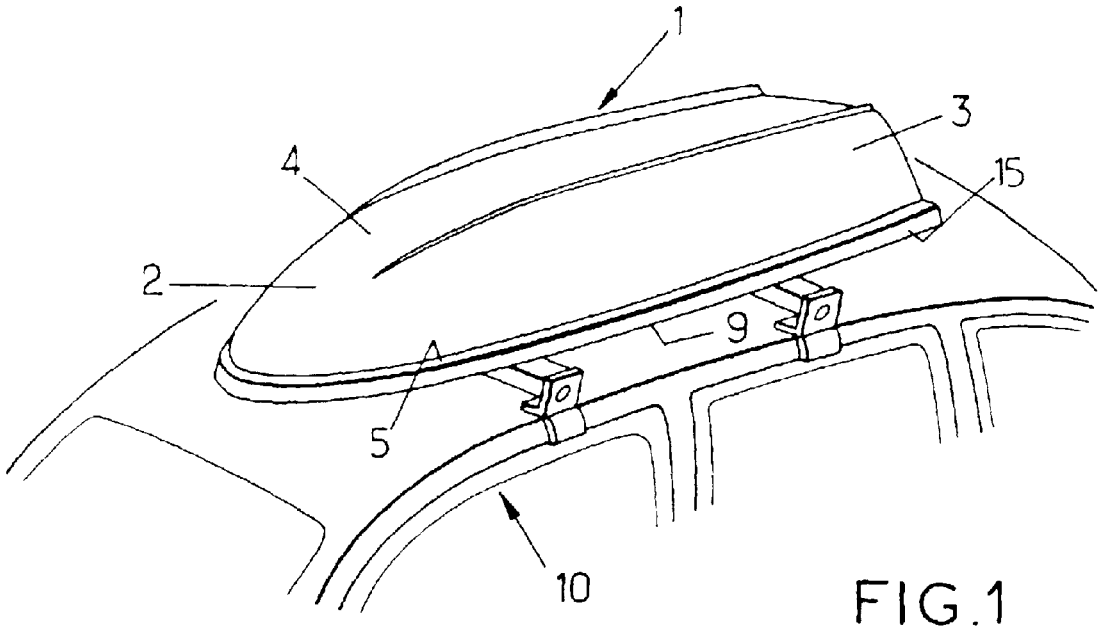
FIG. 1 is a perspective view illustrating the craft forming the subject of the invention in its closed box configuration, installed and stowed on the roof of an automobile.

One of the ends of the tub 1 is profiled both horizontally (the side walls 3 progressively converging) and vertically (the bottom 4 rising progressively up to the height of the peripheral edge 5 of the tub), as can be seen more clearly in FIG. 1, in which the tub 1 is shown upside down.

The other end of the tub 1 is closed by a partition 6 approximately at right angles to the longitudinal axis of the tub.

The tub thus formed is therefore suitable for forming a rigid hull, the first end 2 of which constitutes the front and the second end of which constitutes the rear with the transverse partition 6, which constitutes a stern panel, for example suitable for supporting an outboard drive motor (not shown in FIGS. 1 and 2).

Along the side and front edges of the tub 1 is fixed an elongated inflatable body 7, made of flexible material, in the general shape of a tube, which constitutes an inflatable buoyancy body having the general configuration of a U which is open rearward. The fixing of the inflatable body 7 to the edge of the tub or rigid hull 1 is obtained by means of a bead/channel system according to a technique known for traditional semi-rigid crafts and which is discussed further below.

The inflatable body 7 can be designed and configured in similar fashion to the inflatable body of a traditional composite craft, as can be seen in FIG. 2. Similarly, the stern panel formed by the transverse partition 6 can be arranged and configured in the same manner as a stern panel of a traditional pneumatic craft.

Figure 3:
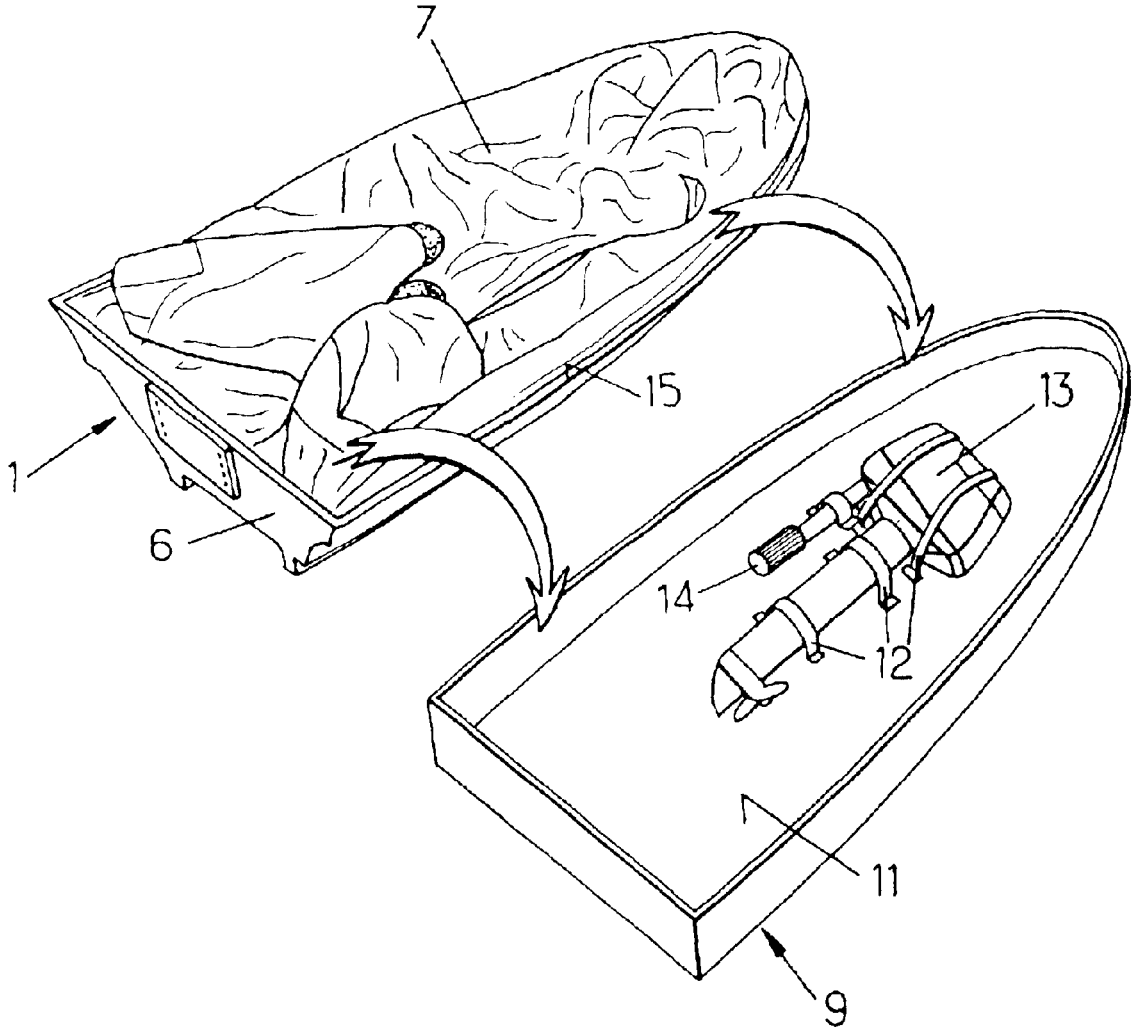
FIG. 3 is a perspective view of the craft of the invention in an intermediate condition, inflatable body emptied and folded up in the tub and lid panel removed.

Finally, as can be seen in FIG. 3, a removable rigid panel 9, made, for example, of the same material as the tub 1, is also provided, which has a peripheral contour matching that of the peripheral edge of the tub 1 and which constitutes a closing or lid panel allowing the tub 1 to be closed.

The contour of the upper edge of the rigid hull and of the stern panel extends approximately in one plane, such that assembly with the rigid panel 9 is facilitated.

All the elements which have just been described can be arranged in two different functional configurations.

On the one hand, it is possible to realise a transportation and storage configuration, illustrated in FIG. 1, in which the inflatable body 7 is deflated and folded up inside the rigid tub 1 (this configuration can be seen in FIG. 3). The tub 1 is in this case arranged in upside down position on the rigid panel 9 forming the bottom lid and is bolted thereon with the aid of fastening means, preferably of the rapid-fastening type not shown in the figures. In this position, the edge of the panel 9 matches the shape of the edge of the tub 1. An outboard motor 13 can be joined to the inner face 11 of the rigid panel 9, following folding or removal of its control handle 14, by means of straps 12 and/or by means of its own motor screws screwed onto an appropriate projecting relief of the panel 9.

A closed box is therefore formed, which facilitates the storage of the craft and the protection of the deflated tube and, more advantageously, furthermore, is fit to be placed and fixed on the roof of an automobile 10, as shown in FIG. 1. The shape of the shell 1, arranged with the prow 2 facing frontward in the direction of travel of the automobile, is appropriate from the aerodynamic aspect. The general shape of the box thus formed is close to that of a roof luggage box for an automobile and its use is similar.

On the other hand, it is also possible to realise a navigation configuration, illustrated in FIG. 2, in which the rigid panel 9 is detached and separate from the tub 1. The inflatable body 7 is inflated under pressure for its shaping around the tub 1, which in this case constitutes a rigid hull, the aggregate of the tub 1 and inflatable body 7 constituting a composite shell.

Figure 4:
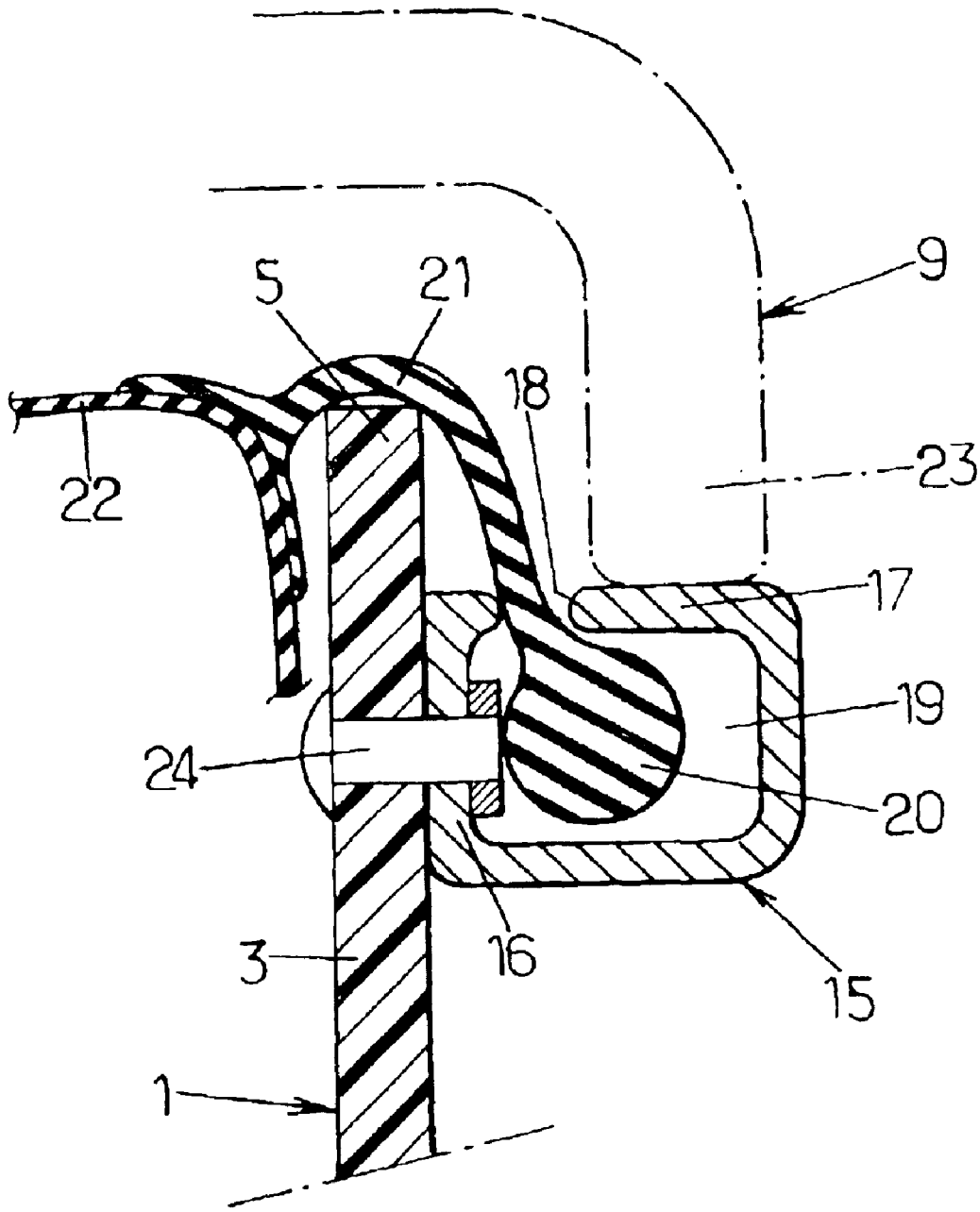
FIG. 4 is a larger-scale view, in cross section, of a profile according to the invention, suitable for equipping the craft of FIGS. 1 to 3 and shown in a functional configuration of the craft.

According to the invention, a rigid profile 15 (especially made of aluminium or plastics material), illustrated on an enlarged scale in FIG. 4, is fixed along the upper edge 5, or close to the upper edge 5, of the rigid hull 1. The profile 15 is fixed on the outer face of the side walls 3 of the hull 1.

The profile 15 has the general appearance of a tubular section, possessing a wall 16 (the left-hand one in the drawing) which is arranged to form a supporting flank against the wall 3 of the hull. This wall of the hull being, close to its upper edge 5, substantially flat in the illustrated example, the wall 16 of the profile possesses an outer face which, in turn, is substantially flat.

The profile 15 also has an upper wall 17, which, over the whole of its length, has an opening or slot 18 disposed along the aforesaid wall 16 or close thereto. In other words, the profile 15 comprises a groove 19 configured with a narrow opening 18, the said groove 19 thus formed being suitable for holding a bead 20 joined by a flexible skirt 21 to the inflatable body 7.

Moreover, the upper wall 17 possesses, in its part situated toward the outside of the groove 18, an outer face which is suitable (that is to say of flat configuration, for example) for acting as support for a lip 23 of the aforesaid panel or removable lid 9, as represented by dash-dot lines in FIG. 4.

The profile 15 is joined to the wall 3 of the rigid hull 1 by means of fixing members such as screws, bolts, etc. In FIG. 1, these joining members are represented by way of example in the form of rivets 24 engaged in mutually aligned holes made in the wall 3 of the hull and the wall 16 forming the supporting flank of the profile 15.

For the rest, the profile 15 can be formed in any appropriate manner. In the example illustrated in FIG. 4, the profile 15 appears in the form of a profile of quadrangular, and especially square or rectangular, general section.

The arrangement according to the invention gives rise to a simple structure, having a profile of uncomplicated and hence uncostly geometric configuration, which is fixed to the outside of the hull such as to free the space inside it, on the one hand, and acquire a reliable sealing tightness when the whole is in navigation configuration.

The added advantage lies in the fact that, as shown in FIG. 4, in the storage/transportation configuration, the deflated tube 22 is swung inside the hull 1, thereby freeing the upper wall 17 of the profile and allowing the lid 9 to be replaced there by its lip 23.

In FIG. 5 is illustrated a constructional variant of the profile 15, whose wall 16, forming a supporting flank against the wall 3 of the hull, extends downward beyond the bottom wall 25 defining the groove 19. This extension appears in the form of a lower wing 26, which increases the supporting surface of the profile 15 against the hull, whereby the mounting of this profile is made more stable.

It is in this case advantageous for the fixing members (for example the rivets 24) to cooperate with this lower wing 26, as illustrated in FIG. 5, in order to free the space in the groove 19 and, above all, prevent the ends of the rivets 24 (or the ends of the bolts or others) from projecting aggressively into the groove 19 and thus prevent the bead 20 from being damaged by these projections.

Provision can also be made, in a manner independent from the previous measures (although they are combinable, as is illustrated in FIG. 5), for the wall 16, forming the supporting flank, and the wall 27, which is opposite thereto, each to be extended upward beyond the upper wall 17. These upper extensions of the walls 16 and 27 define a channel, jointly with the wall 17, in which channel the edge 23 of the lid 9 is received and held transversely, as can clearly be seen in FIG. 5. In addition, the upper extension of the wall 16 helps to increase the supporting surface of the profile 15 against the wall 3 of the hull, and hence the stability of its mounting.

In conjunction with the lower wing 26 extending along the wall 16 of the profile, it is advantageous to add to the profile 15, beneath the groove 19, a tubular part of closed transverse profile which can be quadrangular (square or rectangular) in shape, as illustrated in FIG. 6. This tubular part 28 is in this case defined at the top by the bottom wall 25 of the groove, at the side by the aforesaid skirt 26 and by a lower extension of the aforementioned opposite wall 27, and finally by a lower wall 29.

This arrangement has the advantage that the ends of this tubular part 28, following mounting of the profile 15 on the hull 1, can be sealed off and the water is thereby prevented from passing through the holes traversed by the fixing members (rivets 24). Moreover, the profile 15 thus formed has better rigidity.

Finally, it may be interesting for the walls 16 and 27 opposite the profile 15 to extend at the bottom beyond the aforementioned lower wall 29 and for them to have respectively two opposite, mutually facing lips 30, as illustrated in FIG. 7. A rail 31 is thus formed on the lower part of the profile 15, which rail can serve as the hook-fastening of accessories and, to this end, is able, for example, to receive sliding shoes (not shown), to which accessories can be fixed or attached.

Thus, the profile 15 used according to the invention is suitable for assuring a multiplicity of functions which allow the formation of the craft to be simplified.

What is claimed is:

1. A composite-shell pneumatic craft convertible into a closed box for its storage and/or its transportation, comprising a rigid hull, the upper edge of which extends approximately in one plane, and an inflatable buoyancy body fixed to the edge of the rigid hull—excluding the rear part thereof—by joining means, a removable rigid panel being additionally provided and configured to match the contour of the said edge of the hull in order to form a closing element for the hull, inside which the deflated body has been folded flat, wherein said joining means comprise a profile fixed to the outside of the hull, along the edge or close to the edge thereof, said profile comprising:

a supporting flank against the hull, a portion of said supporting flank being configured to cooperate with members for fixing said profile to the hull, a groove configured with a narrow opening which opens into an upper wall of the profile close to said supporting flank, said groove being suitable for holding a bead joined to a flexible skirt attached to the inflatable body, said upper wall of the profile being suitable, in its part adjacent to said groove opposite to said supporting flank of the profile, for supporting a lip of said removable panel, and a second flank opposite to said first supporting flank, said both flanks projecting above said upper wall and defining an upwardly open channel suitable for holding said removable panel transversely.

2. A craft according to claim 1, wherein the profile is made of plastics material.

3. A craft according to claim 1, wherein the first supporting flank of the profile comprises a wing projecting beneath said groove and in that it is this wing projecting at the bottom which is suitable for cooperating with members for fixing the profile to the hull.

4. A craft according to claim 3, wherein the profile comprises a tubular part situated under said groove and in that one wall of this tubular part is formed by said wing.

5. A craft according to claim 1, wherein said two opposite flanks of the profile extend at the bottom in the form of two lower wings situated opposite each other and defining a rail.

6. A craft according to claim 1, wherein the fixing members are bolts or rivets.

7. A craft according to claim 1, wherein the profile is made of aluminium.

* * * * *